US005402139A

United States Patent [19]

Maeshima

[11] Patent Number: 5,402,139

[45] Date of Patent: Mar. 28, 1995

[54] ANTENNA AND MOUNTING ARRANGEMENT

[75] Inventor: Yasuhito Maeshima, Aichi, Japan

[73] Assignee: Sony Corporation, Tokyo, Japan

[21] Appl. No.: 143,988

[22] Filed: Oct. 27, 1993

Related U.S. Application Data

[63] Continuation of Ser. No. 837,900, Feb. 20, 1992, abandoned.

[30] Foreign Application Priority Data

Feb. 21, 1991 [JP] Japan ..... 3-027071

[51] Int. Cl.[6] ..... H01Q 19/12; H01Q 1/12

[52] U.S. Cl. ..... 343/840; 343/878; 248/230

[58] Field of Search ..... 343/840, 878, 890, 891, 343/892, 912; 248/125, 183, 511, 530, 534, 230; H01Q 1/12, 3/02

[56] References Cited

U.S. PATENT DOCUMENTS

| | | | |
|---|---|---|---|
| 3,299,429 | 1/1967 | McMullin | 343/882 |
| 4,063,701 | 12/1977 | Wray | 248/230 |
| 4,689,637 | 8/1987 | Ochiai et al. | 343/914 |
| 4,748,451 | 5/1988 | Edwards | 343/840 |
| 4,799,642 | 1/1989 | Wright | 343/880 |
| 4,860,021 | 8/1989 | Kurosawa et al. | 343/840 |

FOREIGN PATENT DOCUMENTS

| | | | |
|---|---|---|---|
| 0077250 | 4/1983 | European Pat. Off. | 343/878 |
| 0022802 | 2/1985 | Japan | 343/840 |
| 2120856 | 12/1983 | United Kingdom | 343/757 |

*Primary Examiner*—Donald Hajec
*Assistant Examiner*—Tan Ho
*Attorney, Agent, or Firm*—Jay H. Maioli

[57] ABSTRACT

An antenna and mounting arrangement include a mounting portion attached to a rear of a dish portion of the antenna. The mounting portion may be affixed to a pole and may be positioned at any point along the length of the pole before tightening in position by way of bolts. A length of the mounting portion insures that when secured in position the dish portion of the antenna will not contact the pole. Thus, a plurality of antennas may be conveniently mounted on a single pole.

14 Claims, 1 Drawing Sheet

ANTENNA AND MOUNTING ARRANGEMENT

This is a continuation of application Ser. No. 07/837,900, filed Feb. 20, 1992, now abandoned.

BACKGROUND OF THE INVENTION

1. Field of The Invention

The present invention relates generally to a mounting arrangement for antennas. Particularly, the invention relates to a mounting arrangement for dish, or parabolic antennas which allows a plurality of such antennas to be mounted in a convenient and space saving fashion.

2. Description of The Prior Art

Recently, the popularity and utility of satellite broadcasting has greatly increased. As a result, a large number of satellite antennas has come into use both in individual homes and in satellite communication stations. These antennas, which may be for receiving or transmitting signals usually are in the form of a parabolic dish which is mounted on a pole to be aimed so as to optimally receive or transmit satellite signals.

FIG. 3 shows a conventional mounting system for such a parabolic antenna. As can be seen in the drawing, a parabolic antenna A is mounted atop a pole B via a mounting portion 5, secured by a bolt 12. The mounting portion 5 is joined to the dish body 1 of the antenna at substantially a center portion thereof. The mounting portion 5 comprises a circular cap open on an underside thereof for fitting over a top end or the pole B. After being fitted over the top of the pole B, the mounting portion 5 is tightened via the bolt 12, which fits in a threaded hole 14 to affix the antenna A securely to the pole B.

The above described arrangement has a drawback however, in that, since many locations such as apartment buildings, or satellite communication stations, broadcasting stations etc., may require installation of a plurality of antennas, a large amount of space is required. That is to say, since the cap is a cup-like arrangement closed on the upper side, only one antenna can be arranged on a single pole. This also increases the expense of mounting plural antennas. Also, it will be noted that, in the conventional arrangement, the curvature of the dish intersects the axis of the pole, thus, even if the cap portion were left open, a plurality of antennas could not be mounted. Further, since the mounting portion is in a closed circular form, the antenna must be installed from the top of the pole and cannot be arranged directly at a convenient position along a length thereof.

SUMMARY OF THE INVENTION

It is therefore a principal object of the present invention to provide a mounting arrangement for an antenna which allows convenient, economical mounting of a plurality of antennas in a limited space.

It is a further object of the present invention to provide an antenna which includes a mounting arrangement allowing an antenna to be easily installed at a position selected by the installer.

In order to accomplish the aforementioned and other objects, an antenna according to the present invention comprises: receiving or transmitting means for receiving or transmitting signals; conversion means for converting the signals in a desired fashion; support means, the support means including a support member affixed to a rear side of a dish portion of the parabolic antenna, a spacing member extending from the support member, the spacing member being of a length determined such that the antenna, when operationally mounted, will not come into contact with an antenna mount; and a holding portion formed at an end of the spacing member, the holding portion defining a shape capable of essentially surrounding and tightly gripping the antenna mount and being open in an axial direction of the antenna mount.

According to another aspect of the present invention, a mounting arrangement for a parabolic antenna comprises: a support member affixed to a rear side of a dish portion of the parabolic antenna; a spacing member extending from the support member, the spacing member being of a length determined such that the parabolic antenna, when operationally mounted, will not come into contact with an antenna mount; and a holding portion formed at an end of the spacing member, the holding portion defining a substantially enclosed shape conforming to a cross-sectional shape of the antenna mount and being open in an axial direction of the mount.

DESCRIPTION OF THE PREFERRED EMBODIMENT

Figure 1:
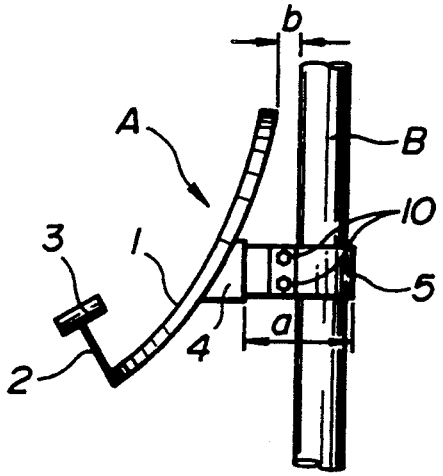
FIG. 1, shows a side view of a parabolic antenna including a mounting arrangement according to the present invention.
Figure 2:
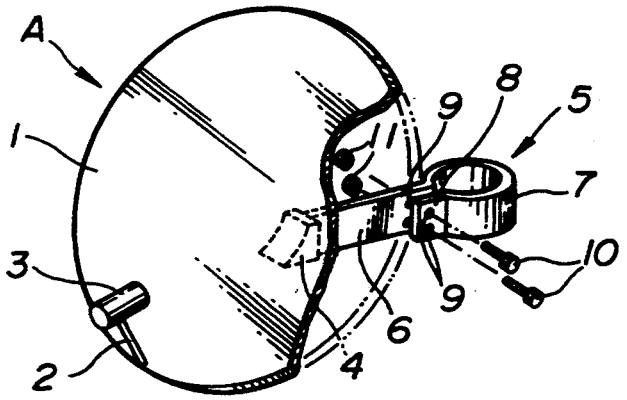
FIG. 2, is a perspective view of the antenna of FIG. 1.
Figure 3:
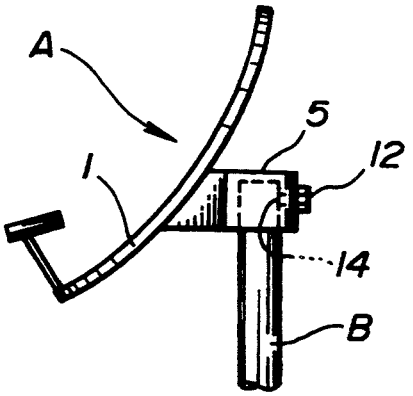
(PRIOR ART) FIG. 3
FIG. 3, shows a conventional parabolic antenna with mounting arrangement.

Referring now to the drawings, particularly to FIG. 1, a satellite antenna A according to the present invention includes a parabolic dish 1, a support portion 4, a mounting portion 5, securing bolts 10, and a signal converter 3 supported on a support member 2. The support portion may be affixed to a substantially center rear portion of the dish 1 by welding, for example, making the antenna A and mounting assembly essentially one unit. As seen in FIG. 2, the mounting portion 5 comprises a spacing member 6, which extends from the support portion 4, at a predetermined length, the spacing member joins a substantially circular holding portion 7. Alternatively, as shown in FIG. 2, the spacing member 6 and the holding portion 7 may be formed integrally.

The circular holding portion 7 terminates in a closing member 8. The closing member 8 and the spacing member 6 have aligning bolt holes 9 to allow insertion of bolts 10 for securing the antenna on a pole B (FIG. 1). When tightened by means of the bolts 10 and nuts 11, The closing member extends in a direction toward the support portion 4, substantially parallel to and contacting the spacing member 6.

It will be noted in FIG. 1 that a length a of the mounting portion 5 from the support member 4 to the outer circumference of the circular holding portion 7 is determined to allow mounting of the antenna A while maintaining a distance b between the upper circumferential edge of the dish 1 and the circumference of the pole B. Thus, when mounting of the antenna A is completed, the parabolic dish 1, when positioned, does not come into contact with the pole B.

Further to say, the arrangement of the present invention allows a plurality of antennas to be mounted on a single pole. That is, once a single antenna has been mounted, a second antenna may easily be added to the same pole with no need to adjust or deinstall any previously mounted antennas.

In addition, though the present embodiment has been described in terms of a parabolic antenna, other types of antennas may be suitably mounted by the arrangement of the present invention. Also, though the embodiment is described in terms of a mounting affixed to a circular pole, the shape of the holding portion 7 may alternatively be determined to be mounted on a pole of a different shape.

Thus, according to the present invention, a plurality of antennas may be easily and economically mounted within a limited space. Further to say, the arrangement of the invention may be simply and inexpensively manufactured.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An antenna comprising:

receiving or transmitting means for receiving or transmitting signals including a parabolic dish portion;

conversion means for converting signals received or transmitted by said receiving or transmitting means;

support means including a support portion welded at only one location to a rear side of said parabolic dish portion of said antenna, a single, unitary spacing member attached to and extending from said support portion, said spacing member being of a length determined such that said antenna, when operationally mounted, will not come into contact with an antenna mount;

a holding portion formed as one piece with said spacing member at an end thereof opposite said support portion, said holding portion defining a circular shape for surrounding and tightly gripping said antenna mount and being open in an axial direction of said antenna mount, said holding portion having a closing member formed at a free end thereof and being arranged proximate said spacing member; and tightening means cooperating with said closing member and said spacing member for causing said holding portion to tightly grip said antenna mount and including a plurality of bolts passing through holes formed in said closing member and being secured to said spacing member.

2. An antenna as set forth in claim 1, wherein a length of said support means is determined so as to leave a predetermined space between an edge portion of said parabolic dish proximate said antenna mount and said antenna mount.

3. An antenna as set forth in claim 1, wherein said conversion means is held at a predetermined position relative to said receiving or transmitting means by a converter support element.

4. An antenna as set forth in claim 1, wherein said mount is a circular pole.

5. An antenna as set forth in claim 1, wherein said tightening means further comprises a plurality of nuts affixed respectively to said plurality of bolts passing through said holes.

6. An antenna as set forth in claim 5, wherein holes are defined in said spacing member and are aligned with said holes in said closing member for accepting respectively said plurality of bolts therethrough.

7. An antenna as set forth in claim 1, wherein said spacing member and said holding portion are formed of a flexible material.

8. An antenna as set forth in claim 1, wherein a shape defined by said holding portion substantially corresponds to a cross-sectional shape of said mount.

9. A mounting arrangement for a parabolic antenna comprising:

a support portion affixed at only one location to a rear side of a dish portion of said parabolic antenna;

a single, unitary spacing member attached to and extending from said support portion, said spacing member being of a length determined such that said antenna, when operationally mounted, will not come into contact with an antenna mount;

a holding portion formed as one piece with said spacing member at an end thereof opposite said support portion, said holding portion defining a substantially enclosed circular shape conforming to a cross-sectional shape of said antenna mount and being open in an axial direction of said mount, said holding portion having a closing member formed at a free end thereof and being located proximate said spacing member; and tightening means cooperating with said closing member and said spacing member for tightly gripping said antenna mount and including a plurality of bolts passing respectively through holes formed in said closing member and being secured to said spacing member.

10. A mounting arrangement as set forth in claim 9, wherein said antenna mount is a circular pole.

11. A mounting arrangement as set forth in claim 9, wherein said tightening means further comprises a plurality of nuts cooperating respectively with said plurality of bolts passing through said holes.

12. A mounting arrangement as set forth in claim 9, wherein said spacing member, said holding portion, and said closing means are formed as one piece.

13. A mounting arrangement as set forth in claim 9, wherein said spacing member and said holding portion are formed of a flexible material.

14. A mounting arrangement as set forth in claim 9, wherein said support portion is affixed to a rear side of said disk portion of said parabolic antenna by welding.

* * * * *